US008070657B2

(12) United States Patent
Loach

(10) Patent No.: US 8,070,657 B2
(45) Date of Patent: Dec. 6, 2011

(54) EXERCISE MACHINE

(76) Inventor: Andrew Robert Loach, Bridge of Allan (GB)

( * ) Notice: Subject to any disclaimer, the term of this patent is extended or adjusted under 35 U.S.C. 154(b) by 94 days.

(21) Appl. No.: 12/281,122

(22) PCT Filed: Feb. 2, 2007

(86) PCT No.: PCT/GB2007/000363

§ 371 (c)(1),
(2), (4) Date: Aug. 28, 2008

(87) PCT Pub. No.: WO2007/099283

PCT Pub. Date: Sep. 7, 2007

(65) Prior Publication Data

US 2009/0036276 A1 Feb. 5, 2009

(30) Foreign Application Priority Data

Feb. 28, 2006 (GB) ..... 0603869.9

(51) Int. Cl.
*A63B 69/06* (2006.01)

(52) U.S. Cl. ..... 482/72; 482/127

(58) Field of Classification Search ..... 482/72, 482/127

See application file for complete search history.

(56) References Cited

U.S. PATENT DOCUMENTS

| | | | | | |
|---|---|---|---|---|---|
| 1,867,642 | A | * | 7/1932 | Woods | 482/125 |
| 2,131,570 | A | * | 9/1938 | Riley | 482/72 |
| 2,951,702 | A | * | 9/1960 | Walter | 482/127 |
| 3,785,657 | A | | 1/1974 | Moller | |
| 3,885,789 | A | * | 5/1975 | Deluty et al. | 482/120 |
| 3,995,853 | A | * | 12/1976 | Deluty | 482/116 |
| 4,010,948 | A | * | 3/1977 | Deluty | 482/120 |
| 4,114,875 | A | * | 9/1978 | Deluty | 482/120 |
| 4,135,714 | A | * | 1/1979 | Hughes | 482/127 |
| 4,253,663 | A | * | 3/1981 | Hughes | 482/127 |
| 4,470,597 | A | | 9/1984 | McFee | |
| 4,557,480 | A | * | 12/1985 | Dudley | 482/120 |
| 4,611,805 | A | * | 9/1986 | Franklin et al. | 482/129 |
| 4,647,035 | A | * | 3/1987 | Yellen | 482/72 |
| 4,746,112 | A | | 5/1988 | Fayal | |
| 4,875,674 | A | * | 10/1989 | Dreissigacker et al. | 482/9 |

(Continued)

FOREIGN PATENT DOCUMENTS

EP 0214748 A2 3/1987

(Continued)

OTHER PUBLICATIONS

International Search Report for PCT/GB2007/000363, Dec. 7, 2007.

*Primary Examiner* — Fenn Mathew
(74) *Attorney, Agent, or Firm* — Brooks Kushman P.C.

(57) ABSTRACT

An improved exercise apparatus is described. The apparatus comprises a cylindrical element and a flexible member associated with the cylindrical element. The flexible member is movable between a wound configuration, in which the member is wound around the cylindrical element, and an unwound configuration, in which the member is unwound from the cylindrical element. The apparatus further comprises a recoil means biased to move the flexible member to the wound configuration and a resistance means that resists movement of the flexible member from the wound to the unwound configurations. The resistance means comprises an energy storage device, which is in a geared relationship with the cylindrical element. In a preferred embodiment the energy storage device is a flywheel.

19 Claims, 12 Drawing Sheets

U.S. PATENT DOCUMENTS

| | | | | | |
|---|---|---|---|---|---|
| 4,880,224 | A | * | 11/1989 | Jonas et al. | 482/72 |
| 5,048,825 | A | * | 9/1991 | Kelly | 482/94 |
| 5,067,709 | A | * | 11/1991 | Christianson | 482/95 |
| 5,199,931 | A | | 4/1993 | Easley et al. | |
| 5,226,867 | A | * | 7/1993 | Beal | 482/127 |
| 5,480,375 | A | * | 1/1996 | La Fosse et al. | 601/23 |
| 5,499,960 | A | * | 3/1996 | Chen | 482/116 |
| D372,507 | S | * | 8/1996 | Chin | D21/687 |
| 5,580,338 | A | | 12/1996 | Scelta et al. | |
| 5,916,069 | A | * | 6/1999 | Wang et al. | 482/72 |
| 6,174,269 | B1 | * | 1/2001 | Eschenbach | 482/132 |
| 6,210,348 | B1 | * | 4/2001 | Reed | 601/23 |
| 6,328,677 | B1 | * | 12/2001 | Drapeau | 482/72 |
| 6,338,703 | B1 | * | 1/2002 | Yu | 482/132 |
| 6,368,259 | B1 | * | 4/2002 | Liao et al. | 482/132 |
| 6,514,182 | B1 | * | 2/2003 | Chhloeum | 482/130 |
| 6,634,995 | B1 | * | 10/2003 | Reed | 482/92 |
| 7,048,638 | B2 | * | 5/2006 | Novotny | 473/219 |
| 7,534,197 | B1 | * | 5/2009 | Harbers, Jr. | 482/40 |
| 7,614,984 | B1 | | 11/2009 | Krull | |
| 7,621,856 | B1 | * | 11/2009 | Keith et al. | 482/127 |
| 2002/0119869 | A1 | * | 8/2002 | Whited Lake | 482/93 |
| 2005/0037902 | A1 | | 2/2005 | Charnitski | |
| 2005/0227827 | A1 | * | 10/2005 | Liester | 482/93 |
| 2006/0148622 | A1 | * | 7/2006 | Chen | 482/72 |
| 2009/0093350 | A1 | | 4/2009 | Jahns | |

FOREIGN PATENT DOCUMENTS

| | | | |
|---|---|---|---|
| GB | 2219410 | A | 12/1989 |

* cited by examiner

EXERCISE MACHINE

FIELD OF THE INVENTION

The present invention relates to an improved exercise machine, particularly but not exclusively to a portable exercise machine.

BACKGROUND TO THE INVENTION

Most existing forms of exercise apparatus are too large or heavy to be easily transported or stowed. Examples include weight lifting equipment, rowing machines, and exercise cycles. Some portable strength-building equipment is available, such as elastic cords, but there is little portable equipment available that allows convenient indoor aerobic exercise.

It is advantageous to monitor and record the performance of the user during exercises. This is commonplace in gym equipment where performance monitors are fitted to most forms of aerobic exercise apparatus. Such a facility is uncommon in low cost portable exercise equipment.

SUMMARY OF THE INVENTION

According to a first aspect of the present invention there is provided an exercise apparatus comprising:

- a cylindrical element;
- a flexible member associated with the cylindrical element, the flexible member movable between a wound configuration in which the member is wound around the cylindrical element and an unwound configuration in which the member is unwound from the cylindrical element;
- a recoil means biased to move the flexible member to the wound configuration; and
- a resistance means that resists movement of the flexible member from the wound to the unwound configurations, the resistance means comprising an energy storage device, the energy storage device being in a geared relationship with the cylindrical element.

There is a need for compact and lightweight exercise apparatus that allows the user to perform a variety of strength-building and aerobic exercises. Such apparatus would be convenient to carry in hand-baggage during travel, and also easy to store in a cupboard or drawer in the home.

In order to achieve an apparatus of low weight and compact size an embodiment of the invention includes a high-speed flywheel driven by a high ratio gear arrangement. For the avoidance of doubt, by "geared relationship" it is meant any form of interaction between two objects in which variation of the speed of one object results in the variation in speed of the other. The interaction between the objects is not limited to engagement of teeth on the objects, the interaction can, for example, be through a frictional engagement. By "cylindrical element" it is meant an element providing a surface around which a flexible element can be coiled.

Preferably, the energy storage device is a flywheel. For the avoidance of doubt, by "flywheel" it is meant an element that continues to rotate throughout periods of varying energy input to the system.

It is desirable that exercise machines such as rowing machines include some form of energy storage device because it allows energy dissipation to occur throughout the exercise rather than in bursts and results in a smoother transition between pulling and return strokes. Typically, some form of flywheel is used to store the kinetic energy imparted on the system by the motions of the user while a resistance mechanism causes energy dissipation from the flywheel. A device with a high level of energy storage is desirable because it results in a smoother motion experienced by the user when compared with a similar device with a lower level of energy storage but the same level of energy dissipation.

Gymnasium exercise machines such as rowing machines and exercise cycles will typically include flywheels with a mass in excess of 6 kg and diameter in excess of 200 mm. The flywheel is typically driven by the cylindrical element via a one-way clutch means. Using a high ratio of gearing between the cylindrical element and the flywheel to greatly increase the speed of rotation of the flywheel allows a smaller flywheel, with a mass as low as 200 g, to be used to achieve the same level of energy storage in a lightweight and compact unit. This high gear ratio and high speed of rotation results in the additional advantage of a lower resisting torque being applied to the flywheel for equivalent energy dissipation—hence a lightweight resistance mechanism can be employed.

Preferably the exercise apparatus includes a one-way clutch arrangement that decouples the flywheel from the cylindrical element during recoil. In a preferred embodiment of the invention, this decoupling is achieved by a simple arrangement of support elements and a spring. This is advantageous because the cost of manufacture of such an arrangement is less than that of typical devices.

According to a second aspect of the present invention there is provided an exercise apparatus comprising:

- a frame;
- a cylindrical element;
- a flexible member associated with the cylindrical element, the flexible member movable between a wound configuration in which the member is wound around the cylindrical element and an unwound configuration in which the member is unwound from the cylindrical element;
- a recoil means biased to move the flexible member to the wound configuration;
- a resistance means that resists movement of the flexible member from the wound to the unwound configurations; and
- attachment means adapted to receive a user's feet
- wherein said frame further comprises at least one rolling element adapted to permit said frame to roll on a floor while supporting the user's feet.

Such an arrangement is beneficial because, in one embodiment of the invention, it provides a compact apparatus that allows the user to perform both strength building and aerobic exercise while being lightweight and possible to arrange into a more compact form for storage or transport. This is in contrast to typical exercise machines in which relatively large and heavy structures are used to support the weight of the user. The frame positions part of the apparatus at a distance above the feet of the user. This allows the user to perform comfortable pulling and return strokes where the handle does not have to be lifted greatly during the stroke to avoid the user's knees. Typical rowing exercise machines comprise a relatively bulky and heavy frame that supports a sliding seat.

Preferably, the apparatus includes means for enabling the user to perform a rowing type exercise, as shown in FIG. 1. A pull-cord unit 1 can be fixed to a wheeled frame 2 and a handle 3 can be attached to the end of the pull-cord 4. The user may sit on the floor or a fixed seat, secure his/her feet to the frame and perform rowing strokes with the frame rolling on the floor to allow a smooth leg extension action. Alternatively a handle may be fixed to the body of the pull-cord unit, with the end of the pull-cord being secured to the user's feet or a rolling frame. The body of the pull-cord unit is then pulled towards the user while the user's legs are extended. Optionally, a number of rollers may be fitted to the user's feet to allow the feet to roll smoothly on the floor.

According to a third aspect of the present invention there is provided an exercise apparatus comprising:

a cylindrical element;

a flexible member associated with the cylindrical element, the flexible member movable between a wound configuration in which the member is wound around the cylindrical element and an unwound configuration in which the member is unwound from the cylindrical element;

a recoil means biased to move the flexible member to the wound configuration;

a resistance means that resists movement of the flexible member from the wound to the unwound configurations; and wireless transmission means that is adapted to transmit exercise data to an external computing device such as, but not limited to, a mobile phone, a PDA, an MP3 player, a games console, or a personal computer.

Such an arrangement is beneficial because, in one embodiment of the invention, a pull-cord unit 1 includes performance measuring means and a radio transmission means that can wirelessly transmit performance data to an external computing device with appropriate radio receiver means. By using the processing, data storage and display capabilities of external devices, complex computing and display functionality does not need to be incorporated into the exercise apparatus. This greatly reduces the cost of manufacture while not inconveniencing the typical user who is unlikely to be often without an appropriate external computing device such as his/her mobile phone. Additionally, the processing, data storage, and display capabilities of up-to-date mobile electronic devices and personal computers are typically well in excess of those capabilities of the performance monitors of even high-end exercise equipment. It is also possible that the external computing device could record and display heart-rate information in addition to exercise performance measures, the heart-rate signal being transmitted to the device from a heart-rate sensor module, such as those worn around the chest, by wireless means.

Wireless protocols such as Bluetooth or Wifi may be used.

According to a fourth aspect of the present invention there is provided an exercise apparatus comprising:

a cylindrical element;

a flexible member associated with the cylindrical element, the flexible member movable between a wound configuration in which the member is wound around the cylindrical element and an unwound configuration in which the member is unwound from the cylindrical element;

a recoil means biased to move the flexible member to the wound configuration;

a resistance means that resists movement of the flexible member from the wound to the unwound configurations;

mounting means to enable the user to arrange the apparatus such that arm-curl or pull-down exercises can be performed.

Such an arrangement is beneficial because, in one embodiment of the invention, it enables the user to perform a variety of strength-building exercises such as arm-curls, as shown in FIG. 2, shoulder pull-downs, as shown in FIG. 3, and leg swings. These are enabled by fixing the pull-cord unit to a secure fixing point such as a doorframe or a fixture on which the user stands. The user then pulls, using a handle means or foot-attachment means, the pull-cord from the pull-cord unit body. Alternatively, the end of the pull-cord may be fixed to a secure fixing point and a handle means fixed to the body of the pull-cord unit such that the user pulls on said handle means, this action causing the pull-cord to be unwound from the pull-cord unit.

According to a fifth aspect of the present invention there is provided a recoil device for an exercise machine comprising a cylindrical element;

a flexible member associated with the cylindrical element, the flexible member movable between a wound configuration in which the member is wound around the cylindrical element and an unwound configuration in which the member is unwound from the cylindrical element;

a first rotating element being coupled to the cylindrical element by a torque transmission means such that said first rotating element rotates in the opposite direction to the cylindrical element; and a coupling means adapted to provide a torsional coupling between the first rotating element and the cylindrical element that results in an torque exerted on the cylindrical element that acts to rotate the cylindrical element in the direction necessary to wind the flexible member onto the cylindrical element.

This method of recoil, wherein, in an embodiment of the invention, a flywheel is coupled to a drum in order to cause rotation of the drum that results in the winding of a pull-cord onto the drum once the pulling force is below a minimum level, is advantageous over the typical method of using a spring element to rewind the cylindrical element because it is potentially more compact and more reliable. Typically, a coil spring would be used. It is very difficult to produce coil springs in a suitably compact form that can store sufficient energy to recoil a pull-cord through many turns and survive many coiling and uncoiling cycles. Even the best examples of such springs typically fail after less than 200,000 cycles which could result in failure of an exercise machine after less than 100 hours of use. Coil springs are also relatively difficult to fit and are a potentially dangerous form of energy storage.

According to a sixth aspect of the present invention there is provided a cable recoil device for an exercise machine comprising a cable that is wound around a drum, a rotating element fitted coaxially with the drum and being coupled to the drum by a torque transmission means such that it rotates in the opposite direction to the drum, a torque transmission means that couples the rotating element to a rotating element that acts as a flywheel with it being possible that rotating elements are combined such that they are the same part, a one directional coupling means being a component of the torque transmission means such that the torque transmission means can only transfer torque between the drum and rotating element in one direction of rotation of the drum, and a coupling means that provides a torsional coupling between the rotating element and the drum that results in an torque exerted on the drum that acts to rotate the drum in the direction necessary to rewind the cable onto the drum.

Other preferred features are set out in the subsidiary claims.

BRIEF DESCRIPTION OF THE DRAWINGS

Embodiments of the invention will now be described with reference to accompanying drawings, wherein:

FIG. 13 is a sectional view. FIG. 14 is an exploded view.

DETAILED DESCRIPTION OF THE DRAWINGS

Figure 4:
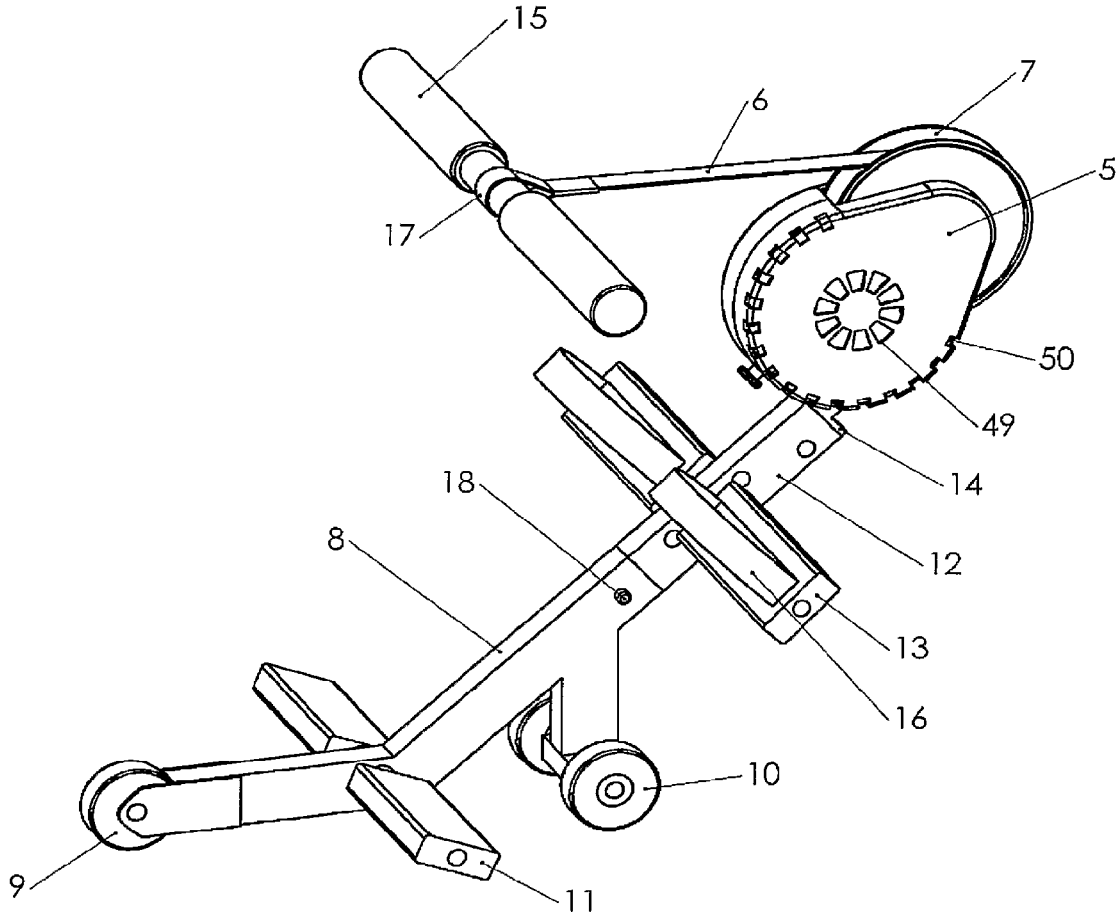
FIG. 4 shows a preferred embodiment of the apparatus configured to allow the user to perform a rowing type exercise.

A pull-cord unit 5, shown in FIG. 4, includes a pull-cord 6 that is wrapped around the inner circumference of a channel that is formed in a drum 7. This pull-cord unit includes a resistance means that resists the pulling of the pull-cord from the drum, and a recoil means that causes the coiling of the pull-cord back on to the drum once the pulling force is reduced.

The pull-cord unit can be used with various accessories to enable the user to perform a variety of strength building, toning, and aerobic exercises.

An exercise frame, shown in FIG. 4, consists of a base frame 8, a single roller 9 fixed at one end of the base frame, a double roller assembly 10, a heel-rest assembly 11, an extension bar 12, a foot-rest assembly 13, and an attachment fixture 14 for mounting the pull-cord unit 5. A handle 15 can be fitted to the end of the pull-cord.

Figure 1:
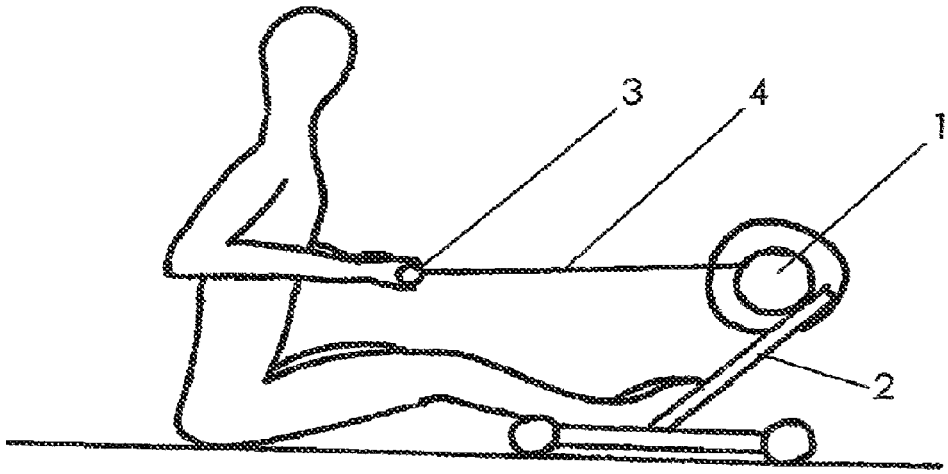
FIG. 1 shows a general arrangement of the apparatus in a configuration that allows the user to perform a rowing type exercise.

The exercise frame enables the user to perform a rowing simulation exercise, as shown in FIG. 1, whereby the user sits on the floor or a cushion or static seat, rests his/her heels on the heel rest and fixes his/her feet to the foot-rest assembly using foot straps 16. The user then pulls the handle 15 away from the pull-cord unit while pushing the exercise frame away from his/her body using his/her legs.

The exercise frame supports the pull-cord unit at a distance above the feet of the user. This allows the user to perform a comfortable rowing stroke where the handle does not have to be lifted greatly during the pulling stroke to avoid the user's knees.

The rollers allow the exercise frame to roll smoothly along the floor while supporting the feet of the user. The pull force that the user exerts on the pull-cord produces a moment acting about the mounting position of the foot-rest assembly 13 that acts to rotate the exercise frame. The single roller 9 is positioned a suitable distance away from the mounting position of the foot-rest assembly such that this rotation is resisted by the moment resulting from the reaction of the single roller 9 with the floor acting about the mounting position of the foot-rest assembly. If this distance were too small then the exercise frame could tip over during exercise.

Alternatively, the handle 15 may be fixed to the body of the pull-cord unit 5, with the end of the pull-cord 6 being secured to the user's feet or a fixture, such as the rolling frame 8. For example, the handle 15 may be fixed to the attachment feature 14. The body of the pull-cord unit 5 is then pulled towards the user while the user's legs are extended.

Figure 5:
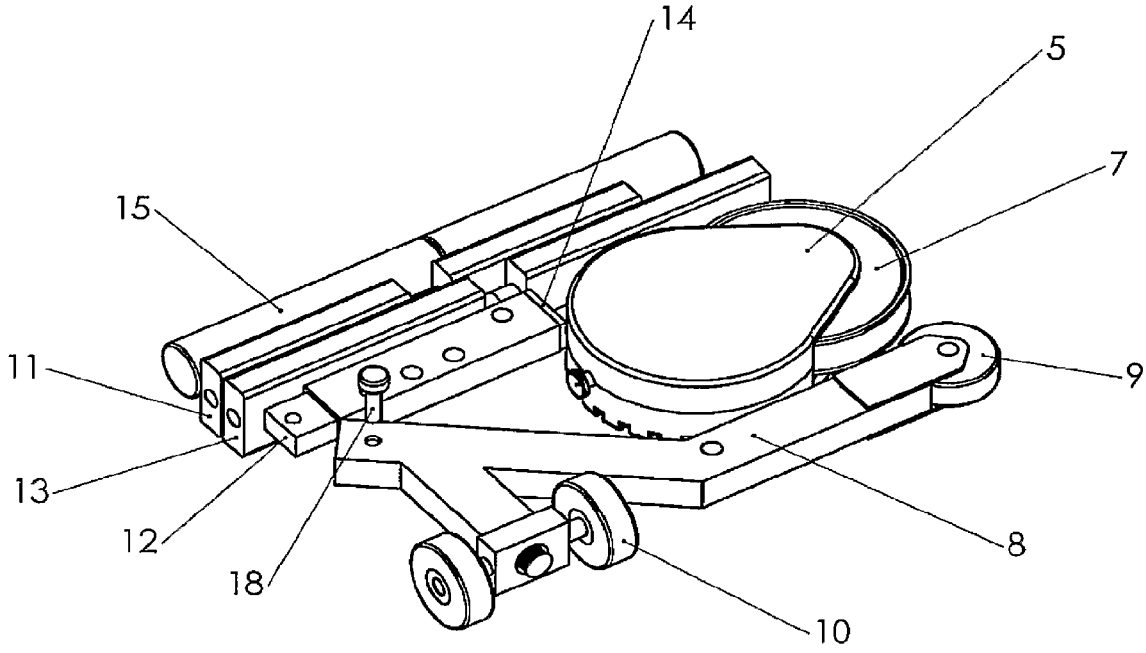
FIG. 5 shows components of the apparatus disassembled and arranged in a compact form for storage or transport.

The exercise frame can be disassembled for storage and transport, as shown in FIG. 5. The handle 15 can be easily fitted and removed from the pull-cord 6 by passing the handle through a loop 17 in the end of the pull-cord. The exercise frame can be disassembled by removing a fixing pin 18 and pulling the extension bar 12 away from the base frame 8. This allows the exercise frame to be arranged into a compact form.

Figure 6:
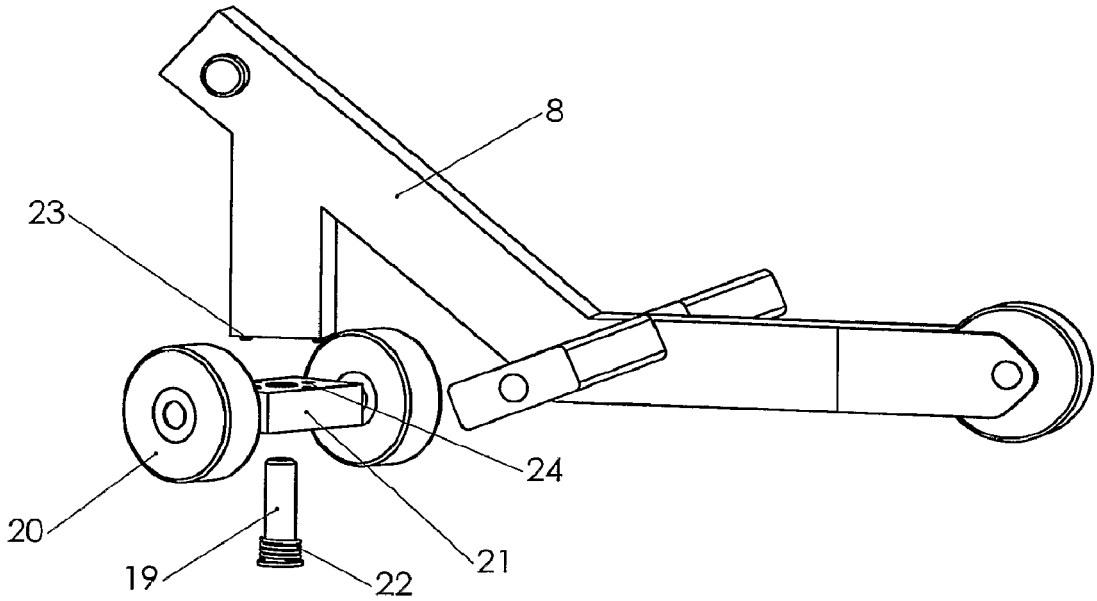
FIG. 6 shows details of a mechanism that fixes the double roller assembly 10 to the base frame 8 and allows the double roller assembly to be mounted in two different orientations, one orientation being useful for operation of the apparatus and the other orientation being useful for storage and transportation of the apparatus.

The double roller assembly 10 is fitted to the exercise frame such that it may rotate about a pivot pin 19 fixed to the base frame 8. FIG. 6 shows this arrangement. Rollers 20 are fixed to a mounting block 21. The pivot pin is fitted through a bore in the mounting block and fixed to the base frame. A compression spring 22 fitted around the pivot pin ensures that the mounting block stays in contact with the base frame. Fixing pins 23 fitted to the base frame can locate in two of four locating bores 24 in the mounting block. This allows the mounting block to be orientated in one of two positions, one position being a position suitable for operation of the apparatus such that the axis of the rollers is parallel to the axis of the single roller 9 and the other position being a position suitable for storage and transport of the apparatus such that the axis of the rollers is perpendicular to the axis of the single roller. It is possible for the user to move the mounting block and rollers between the two positions by pulling the mounting block away from the base frame such that the fixing pin is withdrawn from the locating bores. The compression spring ensures that the mounting block is pushed back over the fixing pin once the fixing pins are aligned with the locating bores corresponding to the new position.

Figure 7:
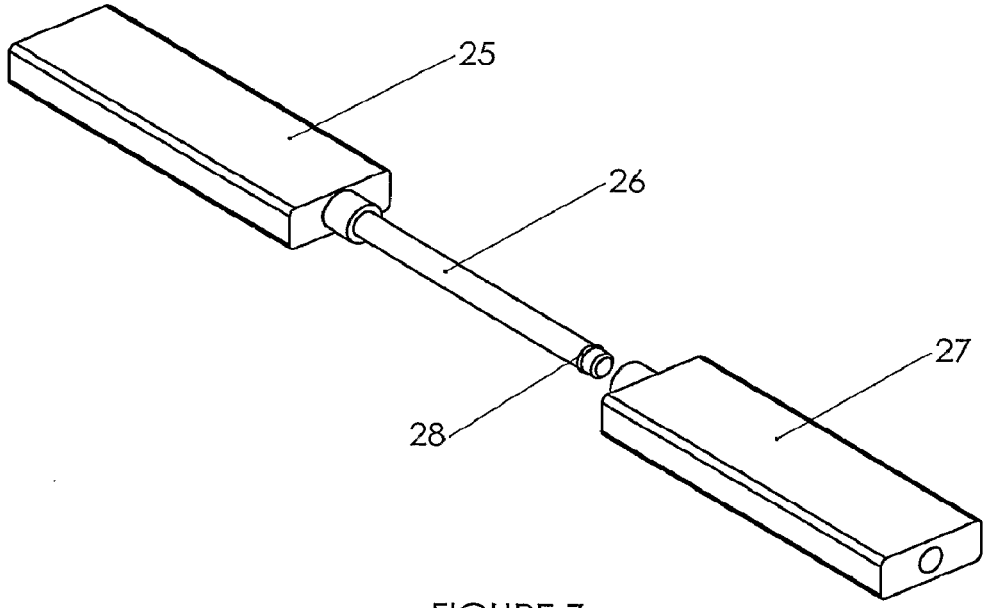
FIG. 7 shows the generic components that make up the foot-rest assembly 13 and the heel-rest assembly 11.

The heel-rest assembly 11 and foot-rest assembly 13 can be assembled and disassembled as shown in FIG. 7. This allows these assemblies to be easily demounted from the exercise frame to allow storage or transport of the apparatus in a more compact form. Each assembly consists of a first block 25, a support bar 26, and a second block 27. One end of the support bar is permanently fixed within the first block. The second block can be fitted to the other end of the support bar. A spring clip 28 is fitted in an external groove formed near the end of the support bar. A bore within the second block includes an internal groove. The internal groove accepts the spring clip when the support bar is pushed into the bore of the second block. This results in the second block being held in position on the support bar by the spring clip. The user can remove the second block from the support bar by pulling the second block away from the support bar with sufficient force to deform the spring clip. Both the heel-rest and foot-rest assemblies are fitted to the exercise frame by fitting the support bar through holes in the exercise frame and then pushing the second block onto the support bar until the spring clip engages the internal groove of the second block.

Figure 2:
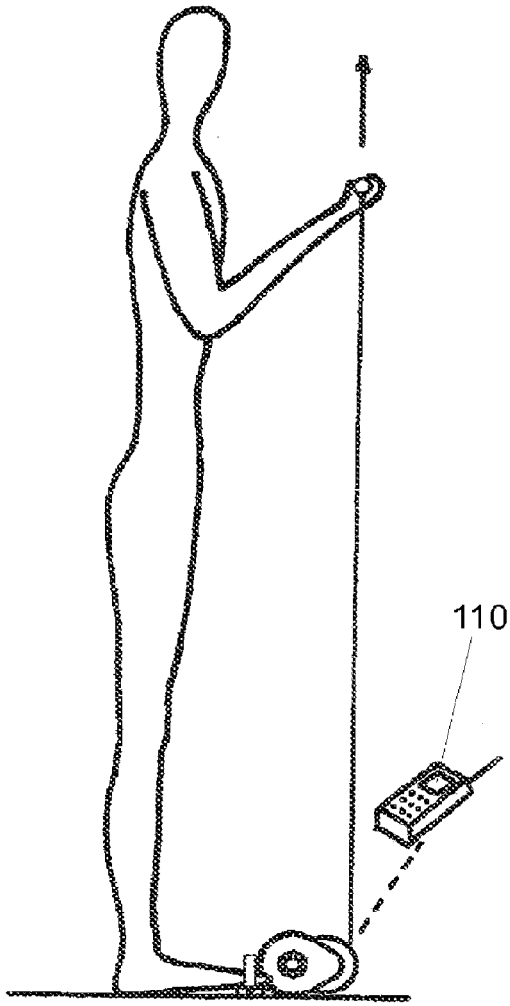
FIG. 2 shows a general arrangement of the apparatus in a configuration that allows the user to perform an arm curling or lifting exercise.
Figure 8:
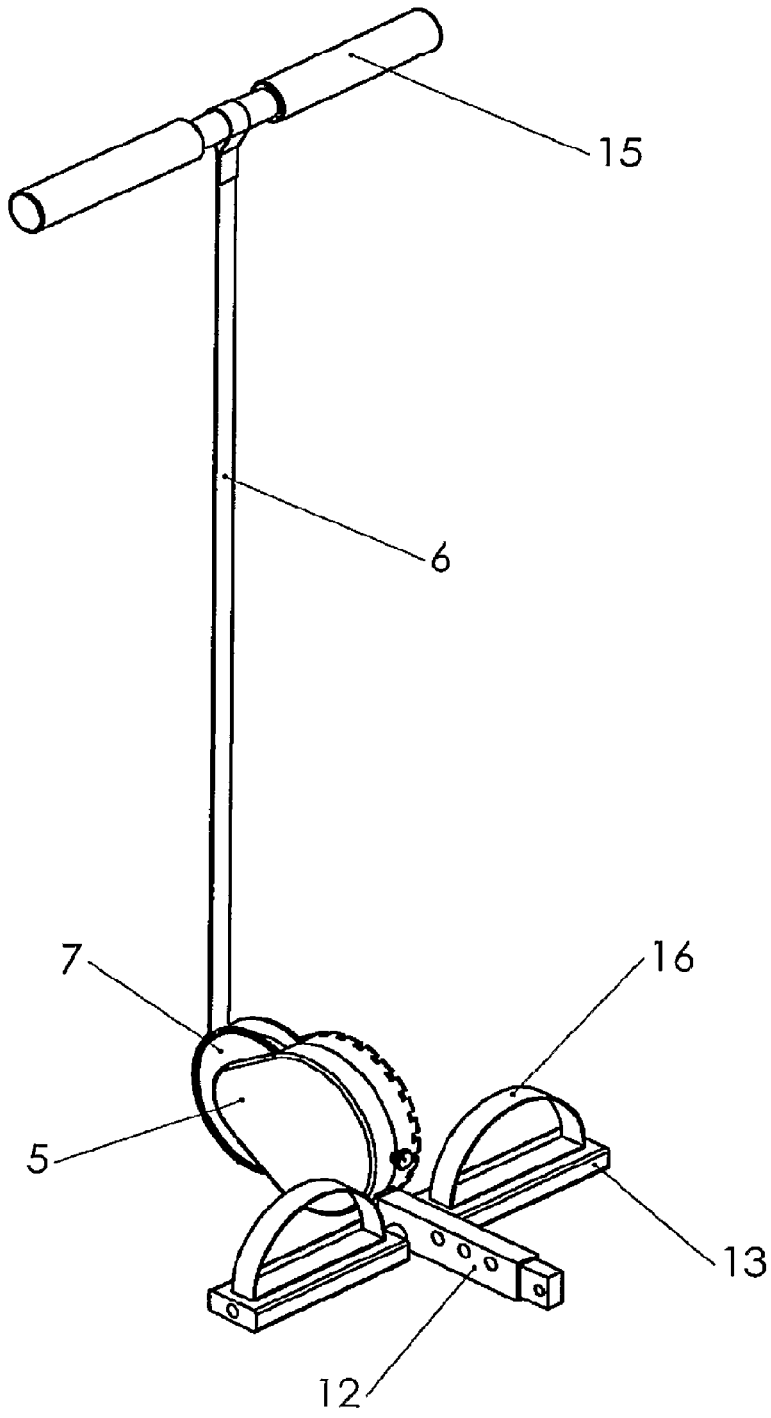
FIG. 8 shows a preferred embodiment of the apparatus configured to allow the user to perform an arm curling or lifting exercise.

The extension bar 12 may be detached from the base frame 8 by removing the fixing pin 18. FIG. 8 shows the apparatus in an arrangement that enables strength building exercises whereby the user stands on the foot-rest assembly 13 and pulls the handle 15 upwards away from the pull-cord unit 5. FIG. 2 shows this arrangement in use with a user performing an arm-curl exercise. Alternatively, the handle 15 may be fixed to the body of the pull-cord unit 5, with the end of the pull-cord 6 being secured to the user's feet or a fixture, such as the foot rest assembly 13. For example, the handle 15 may be fixed to the attachment feature 14. The body of the pull-cord unit 5 is then pulled towards the user while the user's legs are extended.

Figure 3:
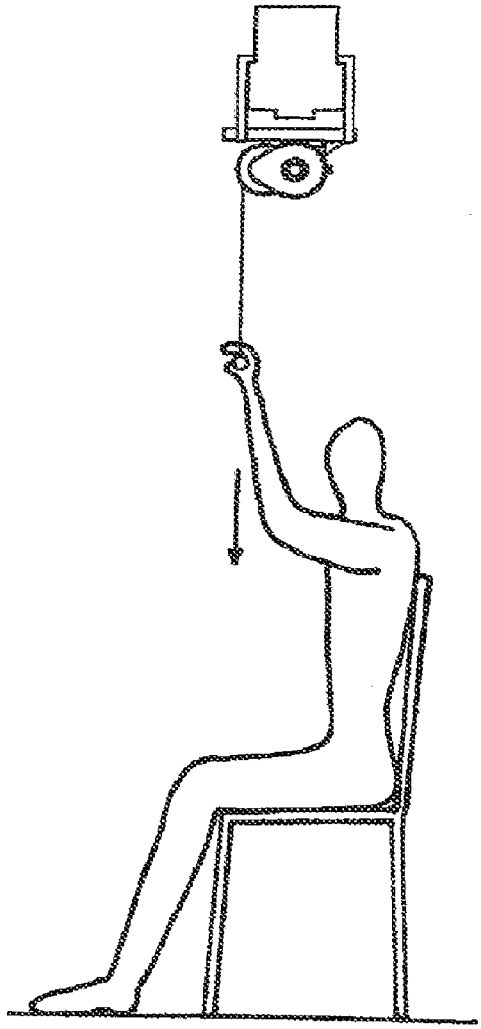
FIG. 3 shows a general arrangement of the apparatus in a configuration that allows the user to perform a pull-down exercise beneath a door frame.
Figure 9:
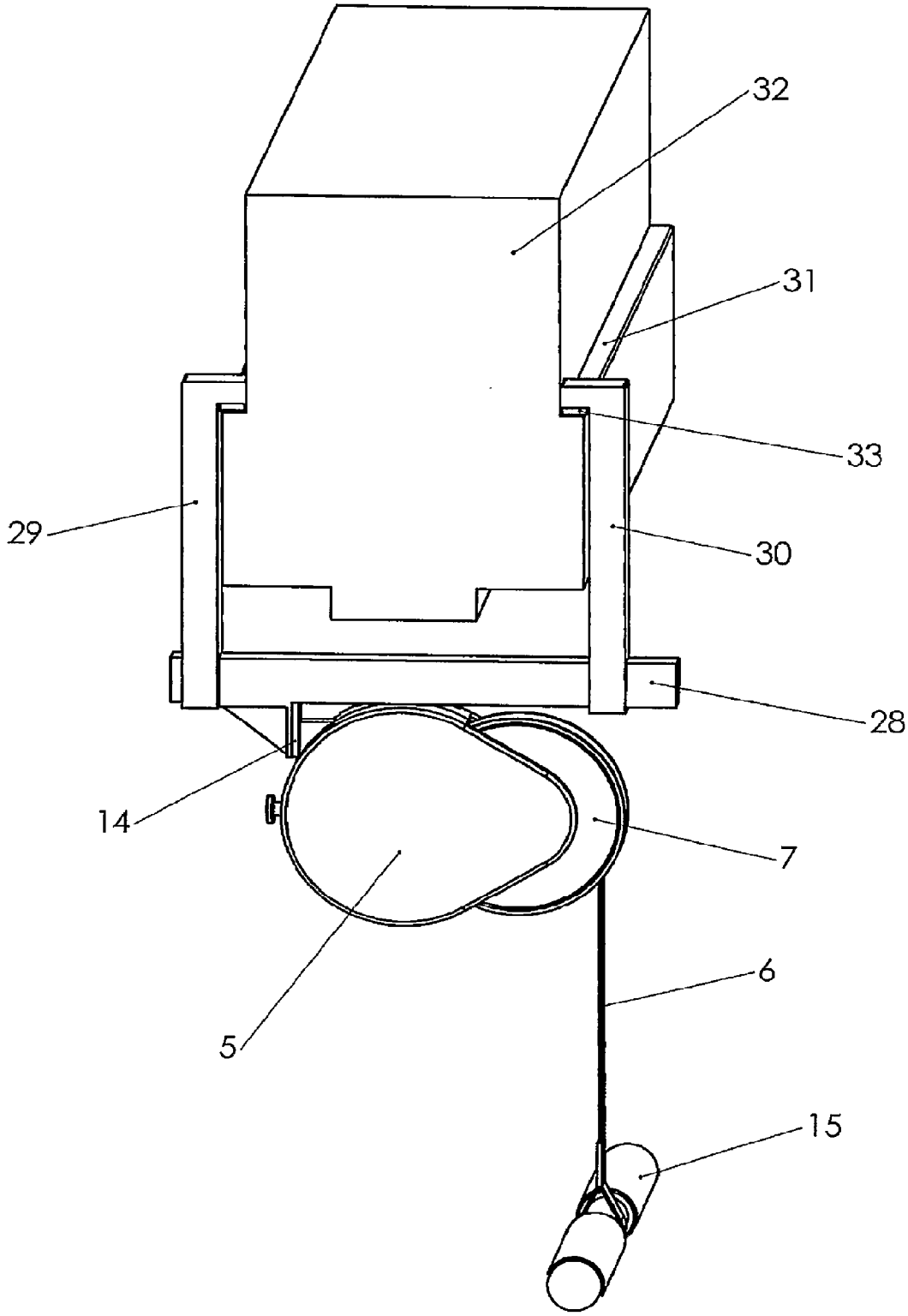
FIG. 9 shows a preferred embodiment of the apparatus configured to allow the user to perform a pull-down exercise beneath a door frame. Only a section of the top of the door frame is shown.

FIG. 9 shows the apparatus in an arrangement that enables strength building exercises whereby the user stands, sits or kneels below a doorframe and pulls the handle 15 downwards away from the pull-cord unit 5, as shown in FIG. 3.

The pull-cord unit is fixed to a cross bar 28. A fixed hook 29 is fitted to one end of the cross bar and an adjustable hook 30 is fitted to the opposite end of the cross bar. The cross bar fits through a slot in the adjustable hook such that the hook may slide along the length of the cross bar. The fixed hook and adjustable hook can be fitted over the top ledges 31 of a doorframe 32. Moving the adjustable hook along the length of the cross bar allows the apparatus to be fitted to doorframes of various thicknesses. Rubber pads 33 fitted to the ends of the fixed hook and the adjustable hook protect the doorframe from damage at the points of contact.

Alternatively, the end of the pull-cord 6 may be fixed to a secure fixing point, such as the cross bar 28. The handle 15 is fixed to the body of the pull-cord unit 5 such that as the user pulls on the handle 15, this action causes the pull-cord 6 to be unwound from the pull-cord unit 5.

Figure 10:
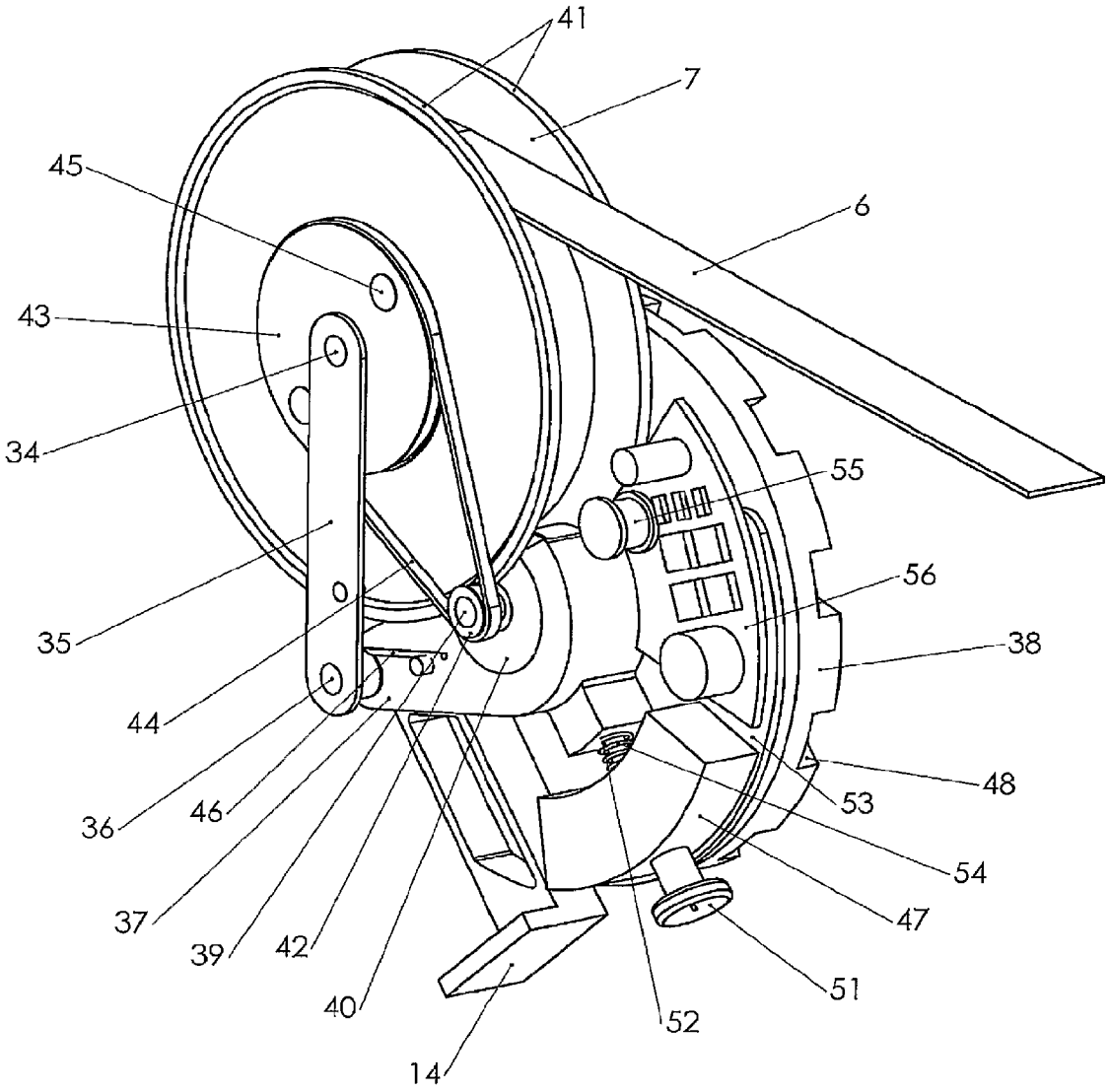
FIGS. 10 and 11 show a preferred embodiment of the pull-cord unit 5 without external casing.
Figure 11:
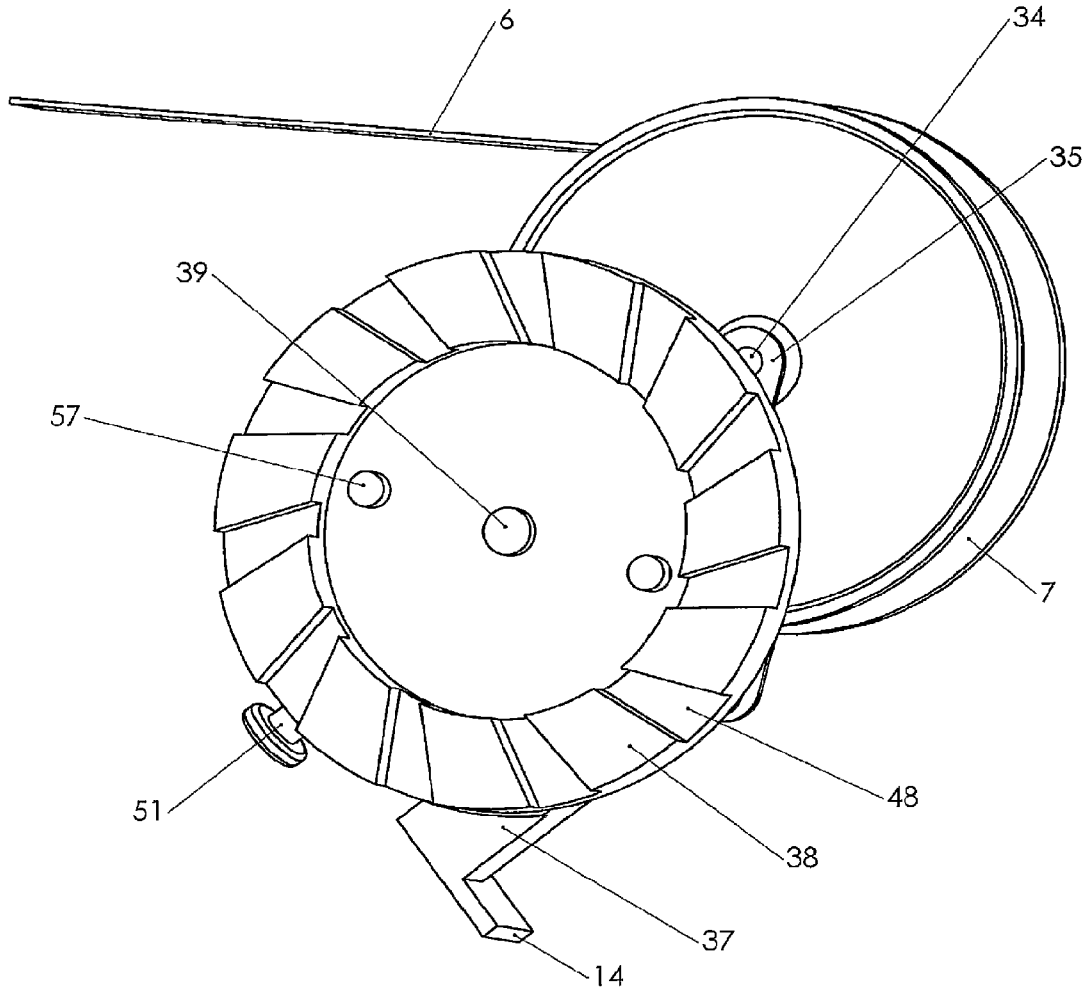

FIGS. 10 and 11 show the pull-cord unit 5 with the external case removed. The pull-cord 6 is fitted at one end with a length of hook-type fastening tape such that said length of tape can wrap once around the circumference of the channel of the drum 7. The drum is fitted with corresponding loop-type fastening tape. This arrangement allows easy attachment and detachment of the pull-cord from the drum. This is useful both for initial manufacture and for replacement of a worn pull-cord by the user. This fastening tape arrangement also limits the force that may be applied to the drum by the pull-cord if the user pulls the pull-cord until it is fully unwound from the drum. The pull-cord can be wrapped around the drum several times while being contained within the channel.

The drum 7 is supported by a bearing that runs on a shaft 34. The shaft is supported by two support arms 35. The support arms are supported by a pin 36 that allows the support arms to pivot about the axis of the pin. The pin is supported by a chassis 37.

A flywheel 38 is fixed to a driveshaft 39 that is supported by a bearing 40 that is fixed in the chassis 37. Application of a pulling force on the pull-cord 6 causes the drum 7 to be pulled towards and into contact with the driveshaft 39. The outer rims 41 of the drum make tangential contact with the driveshaft. The positions of the support arms 35 ensure that while the pulling force is great enough to hold the drum in contact with the driveshaft and the pull-cord remains within a certain angular range relative to the long edges of the support arms, the centre position of this range being the position where the pull-cord is perpendicular to the long edges of the support arms, the reaction force between the outer rims of the drum and the drive shaft will always be great enough to ensure that the contact friction is great enough such that no slipping occurs at this contact. Hence rotation of the drum results in rotation of the driveshaft and the flywheel. While no slipping occurs at the contact, the ratio of the angular speed of the flywheel to the angular speed of the drum is the same as the ratio of the radius of the drum to the radius of the driveshaft at the point of contact. Hence a high effective gear ratio is possible. A high effective gear ratio is desirable because it results in a high angular speed of the flywheel. This results in the kinetic energy stored in the flywheel being equal to the kinetic energy stored in a heavier or larger flywheel that is part of a system with a lower effective gear ratio.

At the opposite end of the driveshaft 39 to the flywheel 38, a small pulley wheel 42 is fitted. A large pulley wheel 43 is fitted to run freely on the shaft 34. The large pulley wheel is coupled to the small pulley wheel by an elastic drive-band 44. The large pulley wheel is fitted with a number of magnets 45 at equal radii from the centre of the large pulley wheel. There is a corresponding number and positioning of magnetic steel plates fitted to the drum 7 such that they face the magnets with a small gap separating them. This arrangement results in a limited maximum coupling torque between the large pulley wheel and the drum. The tension in the drive-band is sufficient such that the drive-band will not slip on either pulley wheel while the torque acting on the large pulley wheel is at or below this maximum coupling torque. This coupling between the drum and the large pulley wheel is mostly elastic in that relative rotation between the large pulley wheel and the drum does not result in a significant net dissipation of energy when the effect is averaged over a number of full rotations of one body relative to the other. The coupling has the effect of applying a torque to the drum in a direction that acts to rotate the drum in the direction necessary to recoil the pull-cord 6 onto the drum.

A torsion spring 46 is fitted such that it acts to move the support arms 35 such that the drum 7 moves away from contact with the driveshaft. Hence when the pulling force applied to the pull-cord 6 drops below a certain level, the drum will move away from contact with the driveshaft 39. In this case the only significant coupling that acts between the driveshaft and the drum is that due to the magnetic coupling between the magnets 45 fixed to the large pulley wheel 43 and said magnetic steel plates fixed to the drum. This results in the rotation of the drum in a direction that will recoil the pull-cord onto the drum while the flywheel 38 continues to rotate.

It is advantageous that the ratio of the diameter of the large pulley wheel 43 to the diameter of the small pulley wheel 42 is less than the ratio of the radius of the drum rims 41 to the radius of the drive shaft 39 at the point of contact. This helps to ensure that the large pulley wheel will not turn so fast that it is unable to accelerate the drum in the recoil direction.

A braking magnet 47 is a permanent magnet magnetised such that opposite poles are formed on the opposite flat parallel sides, one such side being parallel to the flat face of the flywheel 38. The flywheel is made of a conductive metal such as copper or brass. Rotation of the flywheel results in eddy currents being set up within the flywheel. These eddy currents produce magnetic fields that act to oppose the motion that caused them, hence a braking force is exerted on the flywheel. This braking force increases with the speed of the flywheel and therefore provides a convenient speed-dependent resistance to the pulling of the pull-cord 6. The eddy currents produce Ohmic heating within the flywheel. Channels 48 within the flywheel force air to move radially over the outer surface of the flywheel and hence result in a greater rate of heat dissipation from the flywheel.

The fly wheel is designed to be light weight and operate at high speed in order to have the desire energy storage capacity. Preferably the flywheel will have a mass of less than 1kg, a diameter of less than 200 mm and be capable of operating at speeds of over 1000 RPM in normal use.

The pull-cord unit 5 is fitted with a case. This can be seen in FIG. 4. Air intake vents 49 are positioned close to the centre of the flywheel and air exhaust vents 50 are located around the perimeter of the case. This arrangement allows air to be drawn in through the air intake vents and then accelerated within the channels of the rotating flywheel 38 before exiting through the air exhaust vents.

The braking magnet 47 is mounted on an adjustment pin 51. The adjustment pin passes through a hole in the braking magnet and features a threaded end that screws into a threaded hole 52 in the chassis 37. The braking magnet rests against a flat surface 53 of the chassis such that it cannot rotate. A compression spring 54 is fitted between the braking magnet and the chassis such that the braking magnet is pushed against a shoulder of the adjustment pin. Thus the radial position of the braking magnet relative to the flywheel 38 may be adjusted by rotation of the adjustment pin. This adjustment mechanism allows the user to change the level of damping that the braking magnet applies to the flywheel and hence change the intensity of the exercise.

Figure 12:
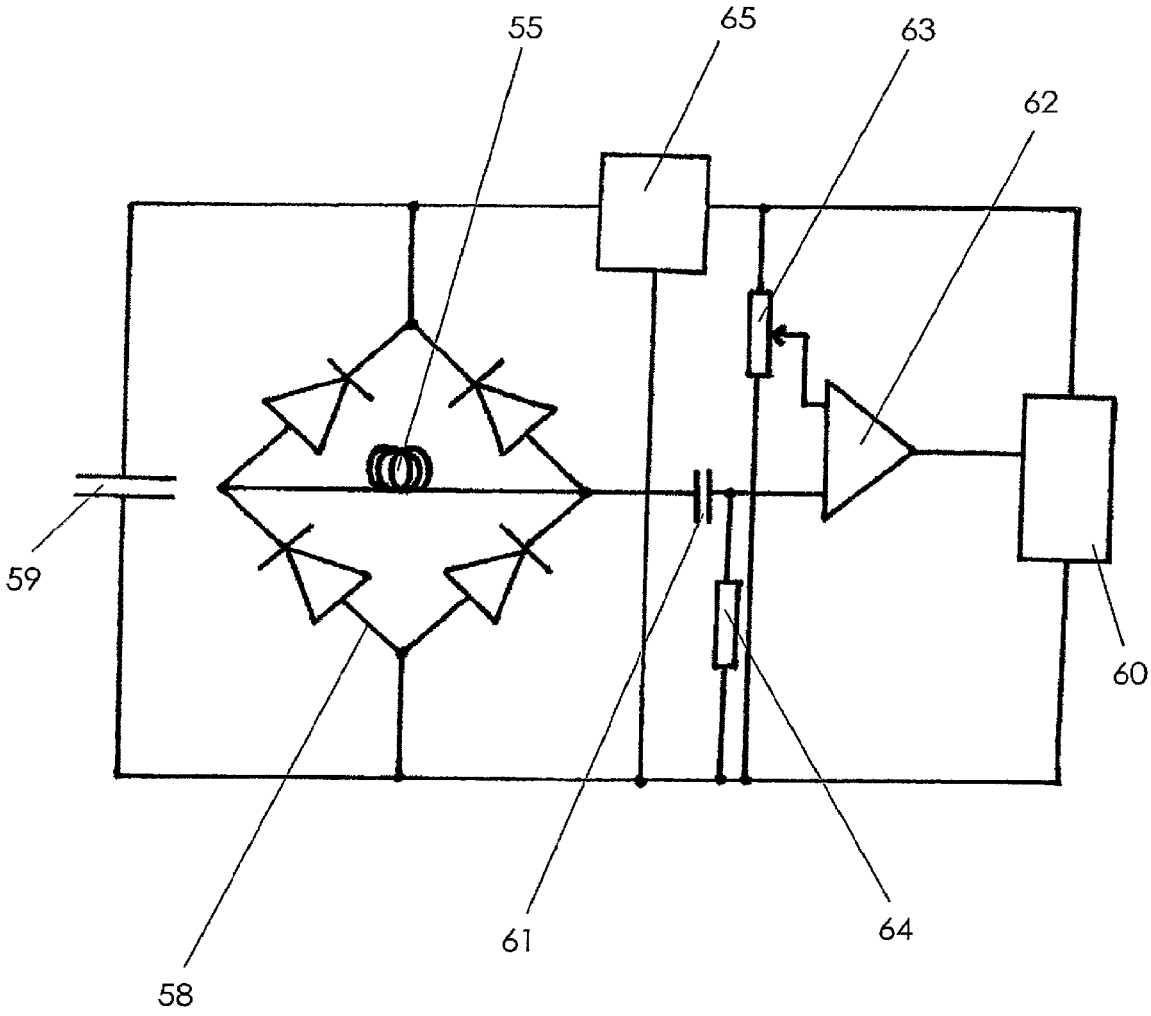
FIG. 12 is a general schematic of the wireless interface circuit.

The pull-cord unit 5 is fitted with a wireless transmission unit that transmits information to an external computing device 110. The external computing device 110 is a mobile phone, according to one embodiment (as shown in FIG. 2). Components of this wireless transmission unit are shown in FIGS. 10 and 11. FIG. 12 shows a general circuit schematic. The wireless transmission unit comprises a power supply circuit, a sensing circuit, and a radio transmission module 60. A coil 55 is fitted to a circuit board 56. Magnets 57 are fitted to the flywheel 38 at a radius such that they pass close to the coil during rotation of the flywheel. Movement of the magnets past the coil induces an electric current in the coil. The power supply circuit connects the coil to the input terminals of a bridge rectifier 58. A large capacitance storage capacitor 59 is connected across the output terminals of the bridge rectifier to smooth the rectified output and provide energy storage for operation of the radio transmission module and the sensing circuit. A voltage regulator module 65 provides a regulated voltage output to the radio transmission module and the sensing circuit.

The sensing circuit provides a voltage pulse to the radio transmission module 60 every time one of the magnets 57 passes the coil 55. A capacitor 61 couples one end of the coil to one input of an operational amplifier 62. A potentiometer 63 provides a threshold voltage at the other input of the operational amplifier. The operational amplifier acts as a comparator such that a voltage occurs at the output once the voltage produced by the coupling to the coil rises above the threshold voltage. A resistor 64 ensures that charge from the coupling capacitor can drain between pulses.

The radio transmission module 60 is an integrated module that includes a radio transceiver and a microprocessor. The module allows radio transmission using the Bluetooth protocol. This protocol allows information to be sent to any device with a suitable Bluetooth interface fitted. Bluetooth interfaces are commonly fitted in mobiles phones, personal-digital-assistants (PDAs), and personal computers. The output from the operational amplifier 62 of the sensing circuit is connected to a digital input of the radio transmission module. The radio transmission module is powered by the power supply circuit. The radio transmission module is programmed to record the time periods between pulses from the sensing circuit. These time period data are transmitted in a radio signal using the Bluetooth protocol. A suitable receiving device can be programmed to receive and process the data such that exercise parameters such as speed, distance, and power can be displayed to the user.

Figure 13:
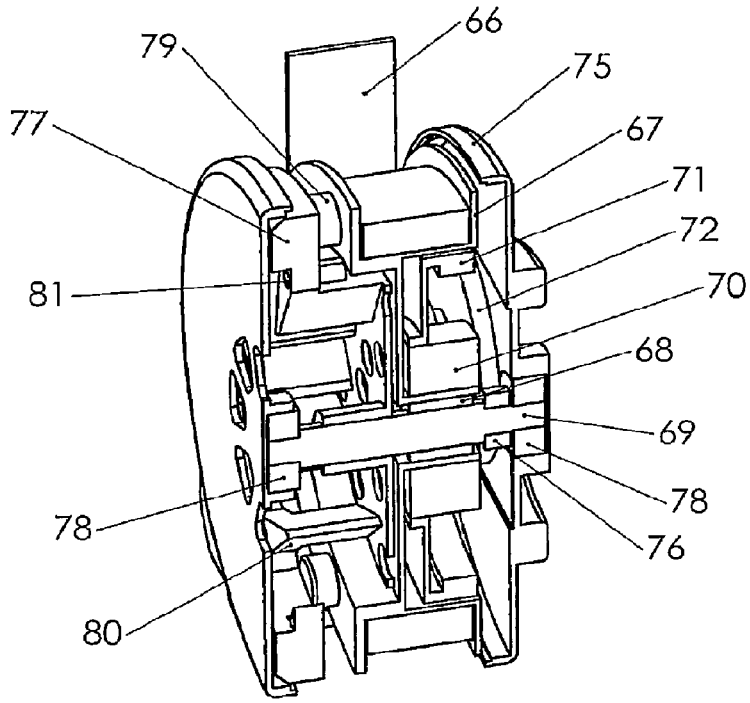
FIGS. 13 and 14 show an alternative embodiment of the pull-cord unit 5.
Figure 14:
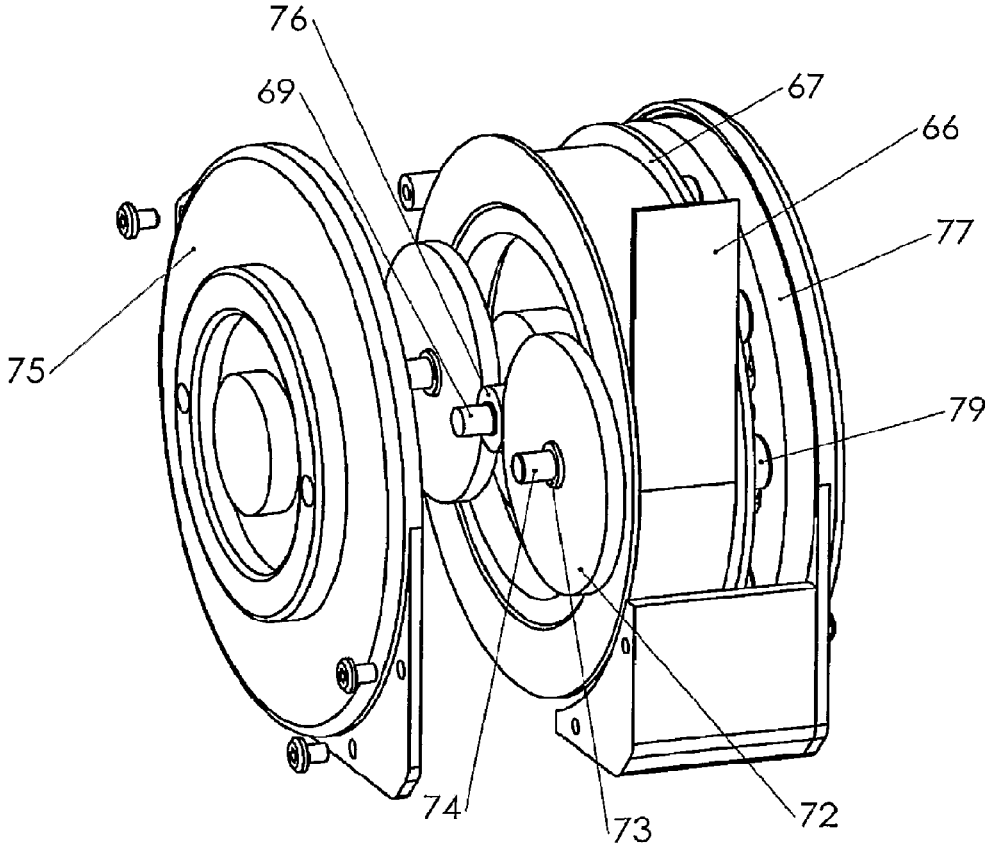
Figure 15:
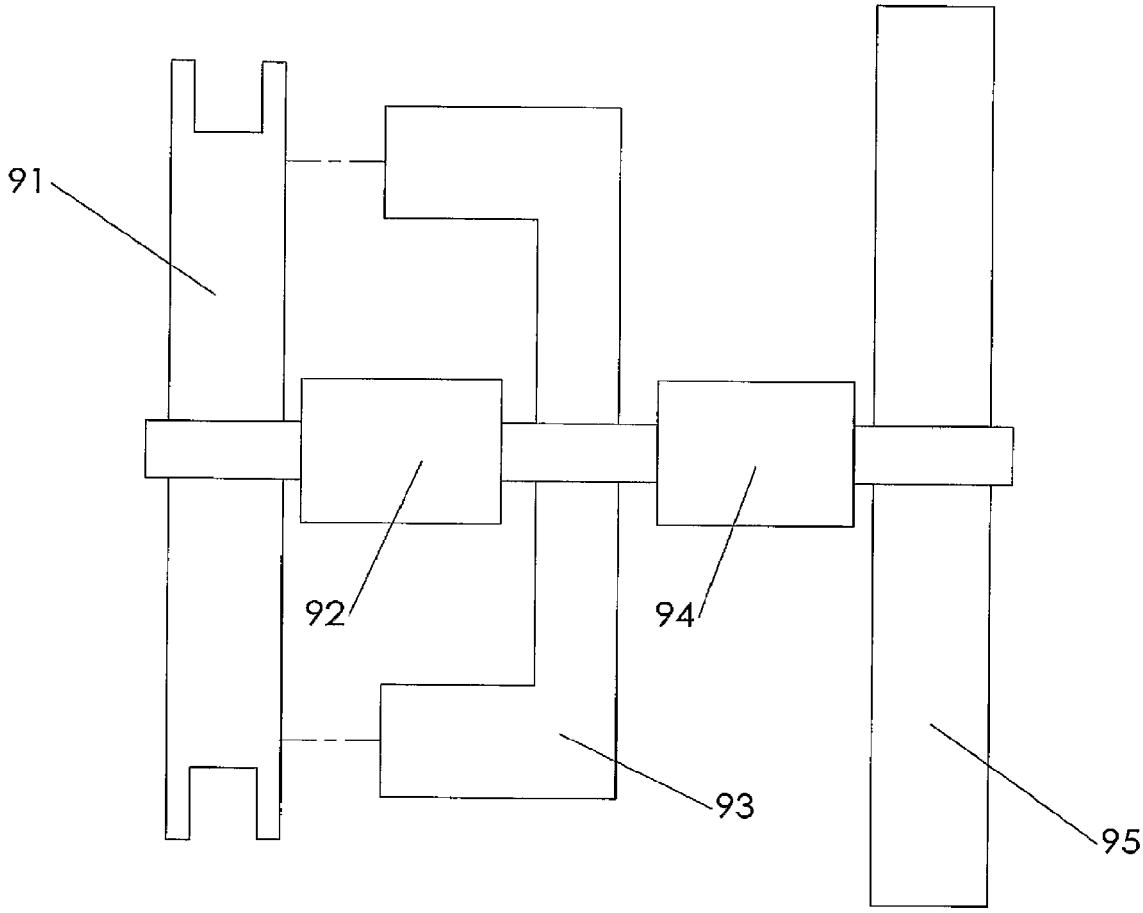
FIG. 15 is a general schematic of a drum recoil system that is driven by a flywheel element. Positional relationships between components should not be inferred from this figure.

FIGS. 13 and 14 show an alternative embodiment of a pull-cord unit for the apparatus. A pull-cord 66 is fitted at one end with a length of hook-type fastening tape such that said length of tape can wrap once around the circumference of a channel formed in a drum 67. The drum is fitted with corresponding loop-type fastening tape. This arrangement allows easy attachment and detachment of the pull-cord from the drum. The pull-cord can be wrapped around the drum several times while being contained within the channel.

The drum 67 is mounted on a bearing 68 that is fitted to a driveshaft 69. The inner race of a spragg type one-way bearing 70 is fitted to the drum such that the rotation axes of the one-way bearing and the drum are collinear. The one way bearing only allows transmission of torque from the inner race to the outer race in one direction of relative rotation between the races. The outer race of the one-way bearing is fixed to an internal gear 71. The internal gear forms the annulus of an epicyclic gear arrangement that provides a high ratio torque transmission between the drum and the driveshaft. The planet gear assemblies 72 of this epicyclic gear arrangement are mounted on bearings 73 that are fitted to shafts 74. These shafts are fixed to an endplate 75 of the pull-cord unit. This endplate is part of the external casework of the pull-cord unit and does not rotate. Each planet gear assembly consists of a double spur gear with a small diameter gear, that meshes with the internal gear, being fixed and concentric to a larger gear that meshes with a sun gear 76. Use of double spur gears allows for a larger gear ratio than would be possible by only using single planetary gears. The sun gear is fixed to the driveshaft. A flywheel 77 is also fixed to the driveshaft. Hence rotation of the drum in one direction results in the rotation of the driveshaft and flywheel in the opposite direction at a much greater speed. The driveshaft is supported within the casework of the pull-cord unit by bearings 78 fitted at each end of the driveshaft.

Rod magnets 79 are fixed to the drum 67 such that they face the flywheel 77 and are arranged in a regular circular pattern about the rotation axis of the drum. Rotation of the drum results in a counter-rotation of the flywheel at a higher speed. The flywheel is made of an electrically conductive metal such as copper or brass. The rotation of the flywheel relative to the rod magnets results in eddy currents being set up in the flywheel. These eddy currents produce magnetic fields that act to oppose the motion that generated them. Hence the motion of the flywheel is damped by eddy current action. The size of the eddy currents is proportional to the relative speed of rotation of the flywheel and the rod magnets. The user therefore experiences a speed-dependent resistance to the pulling of the pull-cord 66 from the pull-cord unit. The torque reaction between the flywheel and the rod magnets is low relative to the torque reaction in the magnetic resistance mechanisms used in typical exercise machines because the gear ratio produced by the epicyclic arrangement is so high. For this reason, smaller or less powerful magnets can be used. It should also be noted that a suitable pull-cord unit may include braking pads that produce a frictional coupling between the drum and the flywheel. It is however advantageous to use a magnetic coupling because a frictional coupling will result in wear of the braking pads that necessitates periodic replacement of the braking pads, and a higher noise level during operation.

The eddy currents produce Ohmic heating within the flywheel 77. Channels 80 within the flywheel force air to move radially over the internal surfaces of the flywheel and hence result in a greater rate of heat dissipation from the flywheel.

The flywheel 77 and rod magnets 79 remain coupled by eddy currents while there continues to be relative rotation between the flywheel and drum 67. This coupling acts to move the drum in a direction that recoils the pull-cord 66 onto the drum and will result in the recoiling of the pull-cord once the pulling force on the pull-cord is reduced to a low enough level. Once the rotation speed of the flywheel drops below a certain level, the size of the coupling torque, due to eddy currents between the flywheel and the rod magnets will no longer be sufficient to move the drum in the recoil direction. For this reason, a number of steel pins 81 are fitted to the flywheel such that they pass close to the rod magnets during rotation of the flywheel. This results in an additional magnetic coupling between the flywheel and rod magnets that is sufficient, even at low speeds of flywheel rotation, to cause the drum to rotate in the recoil direction.

Figure 16:
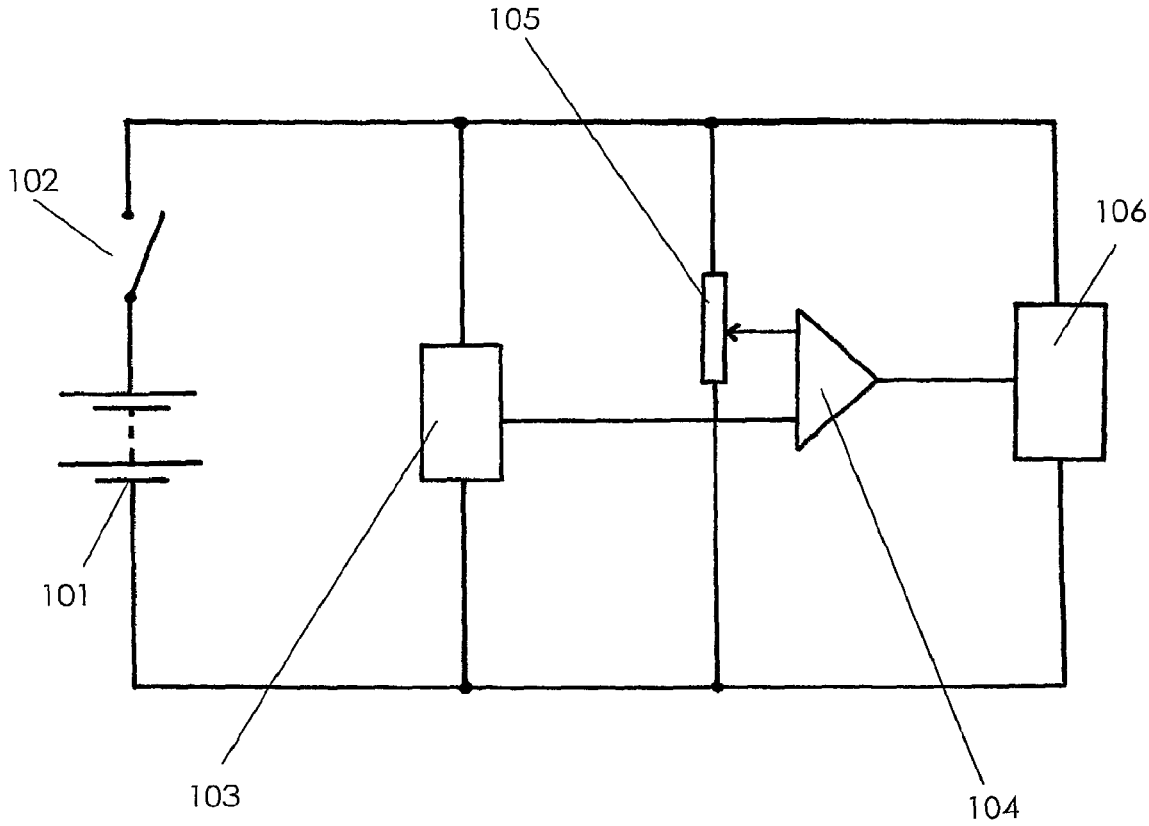
FIG. 16 is a general schematic of an alternative embodiment of a wireless interface circuit.

FIG. 16 shows a general schematic of an alternative circuit for a wireless transmission unit. The circuit is powered by a battery 101. A switch 102 connects the battery to the rest of the circuit. A Hall-sensor module 103 is fitted such that the magnets 57, shown in FIG. 11, pass close to it during rotation of the flywheel 38. The Hall sensor module is an integrated circuit that produces a voltage output that is dependent upon the magnetic flux passing through the Hall sensor module. Hence as the magnets move past the Hall sensor module the voltage output changes. The voltage output from the Hall sensor is connected to one input of an operational amplifier 104. The other input of the operational amplifier is connected to a potentiometer 105 that produces a threshold voltage. When the output voltage from the Hall sensor module rises above this threshold voltage the output of the operational amplifier switches. The output of the operational amplifier is connected to an input of a Bluetooth transceiver module 106. The Bluetooth transceiver module is an integrated module that includes a radio transceiver and a microprocessor. The Bluetooth transceiver module is programmed to record the time periods between pulses from the operational amplifier output. These time period data are transmitted in a radio signal using the Bluetooth protocol. A suitable receiving device can be programmed to receive and process the data such that exercise parameters such as speed, distance, and power can be displayed to the user.

The invention is not limited to the precise details of the embodiments described above.

The invention claimed is:

1. Portable exercise apparatus having a pull-cord unit, said unit comprising:

a chassis;

a drum pivotally mounted to the chassis;

a pull-cord having a first and second end with a flexible member extending there between, the first end attached to a handle to be grasped by a user and the second end connected to the drum, the pull-cord movable between a wound configuration in which the flexible member is wound around the drum and an unwound configuration in which the pull-cord is unwound from the drum;

a recoil means cooperating with the chassis and the drum to rotationally bias the drum in a direction to cause the pull-cord to be in the wound configuration; and a resistance means that resists movement of the pull-cord from the wound to the unwound configuration, the resistance means comprising a light weight high speed flywheel pivotally mounted to the chassis and a resistance mechanism affixed to the chassis and applying a resisting torque to the flywheel, the flywheel coupled to the drum by a one-directional transmission that causes the flywheel to rotate in a constant direction at a higher speed than the drum when the pull-cord is being unwound from the drum, wherein said one-directional transmission couples the drum to the flywheel using a compact planetary gear arrangement;

wherein, during use of the apparatus the user performs a repetitive pull-return motion with the pull-cord unit held in a stationary position so that the user holding the handle can perform a pulling motion causing the drum to rotate as the pull-cord unwinds overcoming the resisting torque on the flywheel applied by the resistance mechanism and then perform a return motion whereupon the recoil means rotates the drum in a direction to cause the pull-cord return to the wound configuration ready for the next pull motion.

2. Portable exercise apparatus according to claim 1 wherein said flywheel has mass less than one kilogram and diameter less than 200 mm.

3. Portable exercise apparatus according to claim 1 wherein said resistance mechanism comprises a magnet element located adjacent to the flywheel, whereby motion of the flywheel is damped as a result of eddy currents being set up in the flywheel.

4. Portable exercise apparatus according to claim 3 wherein the position of said magnet relative to said flywheel can be adjusted by the user such that the level of resistance applied to the flywheel can be changed.

5. Portable exercise apparatus according to claim 3 wherein the flywheel includes radially extending features such that upon rotation of the flywheel air is forced radially outwards, the movement of air resulting in an increased rate of heat dissipation from the flywheel.

6. Portable exercise apparatus according to claim 1 wherein the pull-cord unit is provided with mounting hooks so that the apparatus can be mounted in a doorway to allow the user to perform a pull-down exercise.

7. Portable exercise apparatus according to claim 1 wherein said flywheel continues to rotate as the pull-cord rewinds around the drum during the user's return motion.

8. Portable exercise apparatus according to claim 1 wherein said pull-cord is selected from the group consisting of a cable, cord, rope, strap, and chain.

9. Portable exercise apparatus according to claim 1 wherein said drum provides a surface around which said pull-cord can be coiled.

10. Portable exercise apparatus according to claim 1 wherein said flywheel has mass less than one kilogram, diameter less than 200 mm and is capable of operating at speeds of over 1000 RPM in normal use.

11. Portable exercise apparatus having a pull-cord unit, the pull-cord unit comprising:

a chassis having an attachment feature extending therefrom;

a handle connected to the attachment feature;

a drum pivotally mounted to the chassis;

a pull-cord having a first and second end, the first end being fixed to the drum, the second end being secured to a fixture, the pull-cord being movable between a wound configuration in which the pull-cord is wound around the drum and an unwound configuration in which the pull-cord is unwound from the drum;

a recoil means cooperating with the chassis and the drum to rotationally bias the drum to move the pull-cord towards the wound configuration;

a flywheel pivotally mounted to the chassis, the flywheel being coupled to the drum by a one-directional transmission such that the flywheel rotates in a constant direction at a rotational speed greater than that of the drum while the pull-cord is moved towards the unwound configuration; and a resistance mechanism mounted to the chassis that applies a resisting torque to the flywheel, said resistance mechanism comprising a braking magnet such that rotation of the flywheel results in eddy currents being set up within the flywheel;

whereby the user pulls on the handle during exercise and this action causes the chassis of the pull-cord unit to travel towards the user and the pull-cord to be unwound from the pull-cord unit.

12. Portable exercise apparatus according to claim 11 wherein said one-directional transmission couples the drum to the flywheel using a pair of pulleys and belt which is entrained there about.

13. Portable exercise apparatus according to claim 11 wherein the flywheel comprises radially extending features such that upon rotation of the flywheel air is forced radially outwards, resulting in an increased rate of heat dissipation from the flywheel.

14. Portable exercise apparatus according to claim 11 further comprising a sensor that senses rotation of the flywheel and radio transmission means that transmits exercise data.

15. Portable exercise apparatus according to claim 14 whereby exercise data is transmitted by the radio transmission means and received by a mobile phone, said mobile phone being programmed to receive and process the data such that exercise parameters are displayed to the user.

16. Portable exercise apparatus according to claim 11 wherein the fixture further comprises a foot rest assembly for receiving the feet of the user and resting upon an underlying surface.

17. Portable exercise apparatus according to claim 11 wherein the one directional transmission further comprises:

a driveshaft extending through the chassis, the driveshaft having a first end and a second end opposite the first end, the first end being fixed to the flywheel; and a rim formed at a peripheral surface of the drum for frictionally contacting the second end of the driveshaft, wherein the driveshaft transfers rotational motion from the drum to the flywheel.

18. Portable exercise apparatus having a pull-cord unit, the pull-cord unit comprising:

a chassis;

a handle coupled to the chassis;

a drum rotatably mounted to the chassis;

a pull-cord having a first end and a second end, the first end being attached to the drum, the pull-cord being movable between a wound configuration in which the pull-cord is would around the drum and an unwound configuration in which the pull-cord is unwound from the drum;

a fixture supported by an external surface, the fixture being connected to one of the chassis and the second end of the pull-cord, wherein the handle is connected to the other of the chassis and the second end;

a recoil means biased to move the pull-cord from the unwound to the wound configuration;

a flywheel rotatably mounted to the chassis, the flywheel being coupled to the drum by a one-directional transmission such that the flywheel rotates in a constant direction at a rotational speed greater than that of the drum while the pull-cord is moved towards the unwound configuration, wherein said one-directional transmission couples the drum to the flywheel using a compact planetary gear arrangement; and a resistance mechanism adjustably mounted to the chassis that applies a resisting torque to the flywheel, said resistance mechanism comprising a braking magnet such that the rotation of the flywheel results in eddy currents being set up within the flywheel;

wherein during use of the apparatus the user performs a repetitive pull-return motion with the pull-cord unit so that the user holding the handle can perform a pulling motion causing the drum to rotate as the pull-cord unwinds overcoming the resisting torque on the flywheel applied by the resistance mechanism and then perform a return motion whereupon the recoil means rotates the drum in a direction to cause the pull-cord return to the wound configuration ready for the next pull motion.

19. Portable exercise apparatus according to claim 16 wherein the handle is connected to the chassis and the fixture is connected to the second end of the pull-cord, and wherein the drum and chassis travel with the handle during use of the apparatus.

* * * * *